United States Patent [19]

Arola et al.

[11] Patent Number: 4,972,889

[45] Date of Patent: Nov. 27, 1990

[54] SELF-FEEDING WOOD CHUNKER

[75] Inventors: Rodger A. Arola, Hancock, Mich.; Jörgen Marks, Falun, Sweden

[73] Assignee: The United States of America as represented by the Secretary of Agriculture, Washington, D.C.

[21] Appl. No.: 325,804

[22] Filed: Mar. 20, 1989

[30] Foreign Application Priority Data

Mar. 25, 1988 [SE] Sweden ..... 8801128

[51] Int. Cl.[5] ..... B27L 11/02

[52] U.S. Cl. ..... 144/176; 144/162 R; 241/235; 241/296

[58] Field of Search ..... 144/176, 3 R, 193 R, 144/162 R; 241/235, 296

[56] References Cited

U.S. PATENT DOCUMENTS 4,282,910 8/1981 Kilpelp et al. ..... 144/3 K
4,431,039 2/1984 Barwise et al. .
4,630,658 12/1986 Arola et al. .

FOREIGN PATENT DOCUMENTS 8402661-6 5/1984 Sweden .

*Primary Examiner*—W. Donald Bray
*Attorney, Agent, or Firm*—M. Howard Silverstein

[57] ABSTRACT

The invention relates to a self-feeding wood chunker having cutting instruments (1, 2) rotating in opposite directions but with the same speed, which have, on surfaces facing one another, at least one cutting blade ($3_1$, $3_2$ and $4_1$, $4_2$), the blades being curved in the direction of rotation such that the leading part (3*a*, 4*a*) thereof is nearer to the periphery of the respective cutting instrument and that the trailing part (3*a*, 4*a*) thereof is nearer to the axis of rotation (1*a*, 2*a*) of the respective cutting instrument. According to the invention, the cutting instruments (1, 2) are arranged with the axes of rotation (1*a*, 1*b*) displaced a definite distance (B) from one another.

6 Claims, 3 Drawing Sheets

SELF-FEEDING WOOD CHUNKER

The present invention relates to a self-feeding wood chunker comprising [two] cutting instruments rotating in opposite directions but with the same speed, which have, on surfaces facing one another, at least one cutting blade, the blades being curved in the direction of rotation such that the leading part thereof is nearer to the periphery of the respective cutting instrument and that the trailing part thereof is nearer to the axis of rotation of the respective cutting instrument.

A concept of the kind described above for comminuting wood to firewood of convenient dimensions is described in U.S. Pat. No. 4,630,658. In this known concept, the cutting instruments have a common axis of rotation and the blades are basically shaped so that at each point they are at the same distance from the common axis of rotation of the cutting instruments. Because of this shape, the edges of the blades will be at the same distance from the common axis of rotation throughout the entire cutting operation, which means that the material being cut will in principle remain stationary with respect to the infeed direction. In this embodiment the feeding of material must take place exclusively by means of separate, external feed devices. This makes it difficult to achieve even, uniform feeding, so that problems are likely to arise if the equipment has to operate at high speed.

In the descriptive text of the above patent application it is also stated that alternatively the blades may be curved such that each consecutive point along the cutting edge of the blade is closer to the axis of rotation of the disk than the preceding point. This embodiment is intended to solve the aforesaid problem of feeding the material, since blades with this shape tend to draw the material forward during cutting. This known shape of the blades admittedly achieves self-feeding as the material is being cut; but at the same time, since the cutting instruments have a common axis of rotation, cutting becomes less satisfactory, since the blades will cross over one another throughout the cutting process, i.e. they will not work together over any portion of the cutting edges but will only do so at isolated points. This is a particular disadvantage at the trailing ends of the blades where the final severing of the material takes place. This kind of interaction between the blades results in considerably increased stress on the equipment, a higher power requirement, and an inferior result, and for these reasons is probably not usable in practice.

The aim of the present invention is therefore to produce a wood chunker of the type initially described, by means of which effective self-feeding of material throughout the cutting process can be achieved, while still retaining effective comminution of the material, comparatively low stresses, and a low power requirement for the equipment.

Figure 1A:
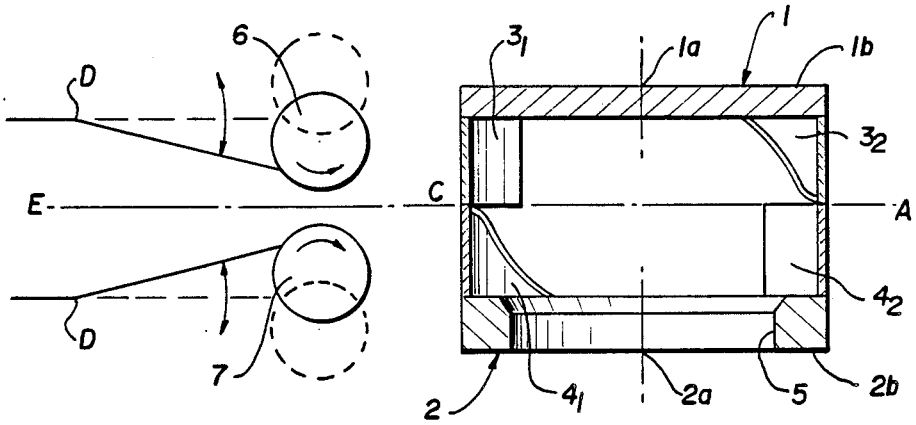
Figure 1B:
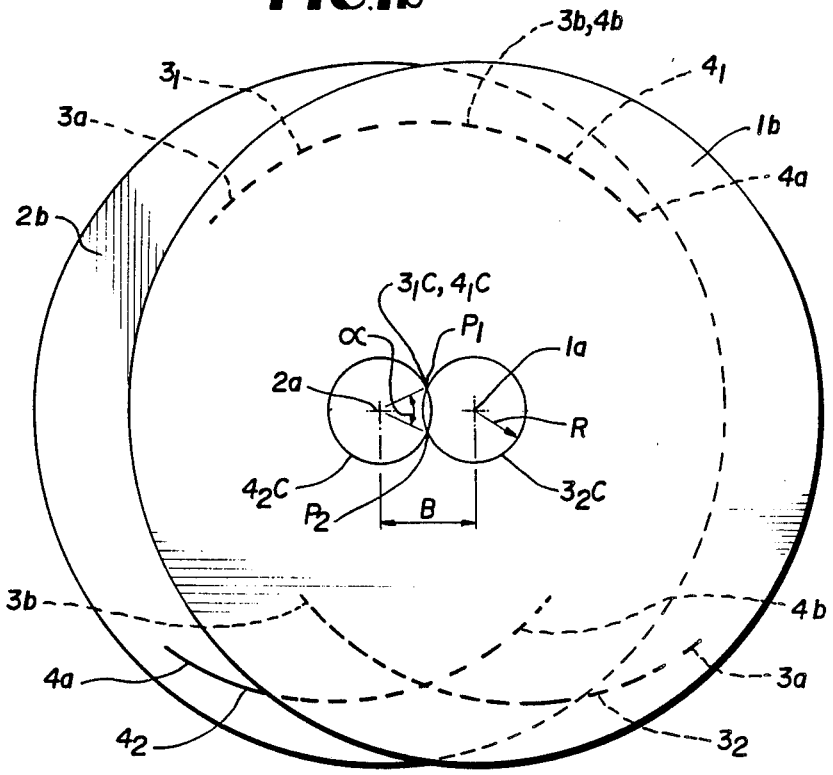
Figure 3:
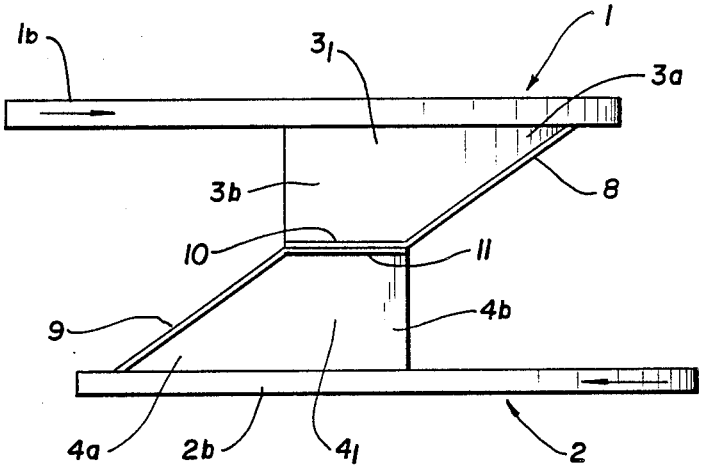
Figure 2:
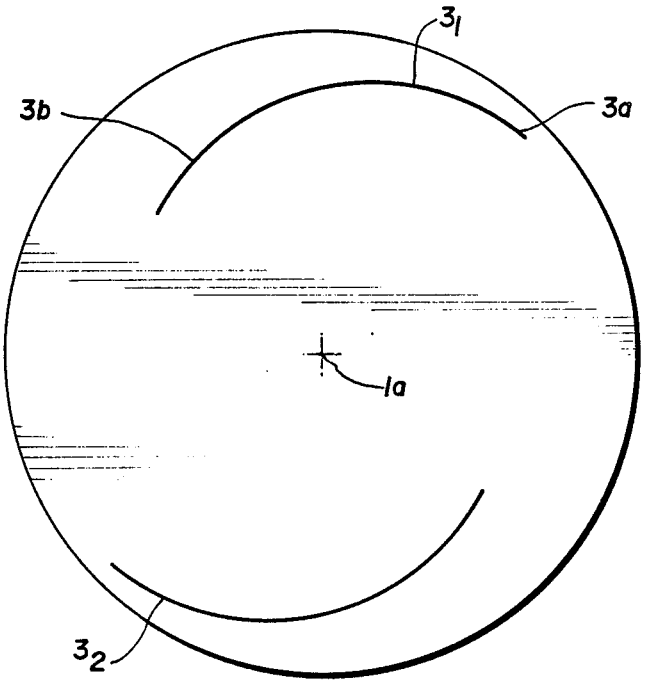
Figure 4C:
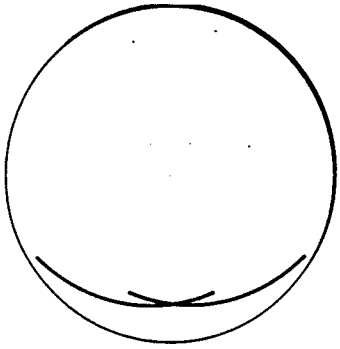
Figure 5C:
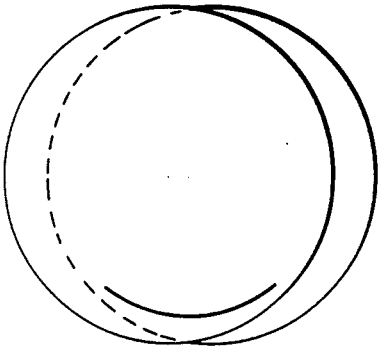
Figure 4B:
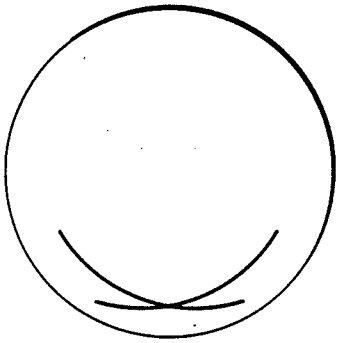
Figure 5B:
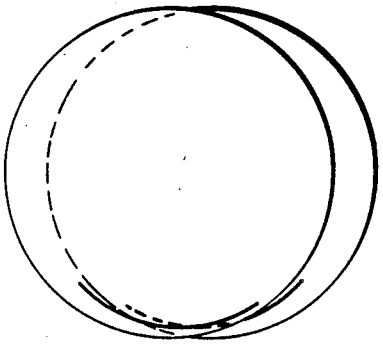
Figure 4A:
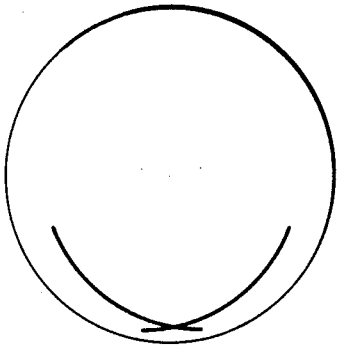
Figure 5A:
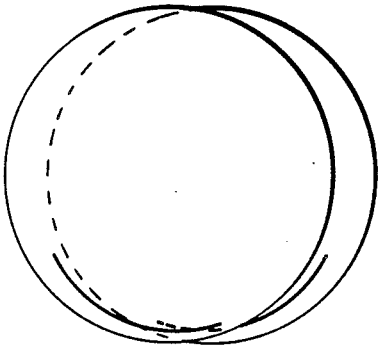

An embodiment of the invention will now be described in more detail below in connection with the appended diagrams, in which:

FIG. 1*a* is a schematic side view of the cutting instrument used in the wood chunker according to the invention and of an infeed device in connection with this, FIG. 1*b* is a schematic plan view from above of the cutting instrument shown in FIG. 1*a*, FIG. 2 is a schematic plan view from below of the cutting instrument in FIG. 1 above, FIG. 3 is a schematic side view of the cutting instrument shown in FIG. 1, looking in the direction of the arrow E, FIGS. 4*a–c* illustrate the principles of self-feeding in an embodiment according to the state of the art, and FIGS. 5*a–c* illustrate the principles of self-feeding as achieved according to the present invention.

As is shown in a very schematic way in FIG. 1*a*, the wood chunker according to the present invention has a pair of cutting instruments 1, 2 which are journaled in bearings in a stand (not shown) so as to rotate about axes of rotation 1*a* and 2*a*. The cutting instruments 1, 2 are arranged with the axes of rotation 1*a*, 1*b* displaced a definite distance B from one another (FIG. 1*b*) and are caused to rotate in opposite directions by means of a drive mechanism not shown in the diagrams. It is convenient to drive both cutting instruments from the same drive mechanism via a transmission, but it is also possible to use other known drive mechanisms. The important thing is to make the cutting instruments rotate in opposite directions at exactly the same speed, i.e. so that the cutting instrument blades $3_1$, $4_1$ and $3_2$, $4_2$, which work together, always meet in exactly the same position on each revolution of the cutting instruments.

Cutting instruments 1 and 2 basically consist of disk-shaped blade supports 1*b* and 2*b*, on whose facing surfaces are fixed blades $3_1$, $3_2$ and $4_1$, $4_2$ respectively. These blades are set with their edges facing one another so that parts of the edges meet in a plane A for final severing of the material. The precise shape of the blades 3 and 4 will be discussed in more detail below.

In the embodiment shown in FIG. 1*a*, the disks 1*a* and 1*b* are mounted horizontally one above the other. The upper disk 1*b* is solid, while the lower disk 2*b* has a central opening 5 through which material cut off is automatically removed by gravity feed. Alternatively, the disks may be mounted vertically. In this case, both disks are solid and the material cut off passes out between the disks. The first embodiment, with horizontal disks and a central opening 5 in the lower disk, gives more effective output feed and in particular allows a greater number of blades to be placed on the cutting instrument. The alternative embodiment, with disks arranged vertically, can only be used with a smaller number of blades, since these would otherwise be placed so close together around the periphery of the disk that they would interfere with effective removal of the cut-off material.

FIG. 1*a* also indicates, very schematically, an infeed device for feeding in the working materials to the cutting zone of the cutting instruments, or infeed zone C. Concerning this infeed device, reference can be made, for example, to the aforesaid U.S. Pat. No. 4,630,658. It should just be mentioned that the infeed device should have two horizontally mounted feed rollers 6, 7, which are pivoted at D in the infeed area to the cutting instruments. These are held against one another by spring loading, so that they are self centering toward the line of cutting force and will touch plane A, where the blade edges meet, when there is no working material between the rollers 6, 7.

As can be seen from the diagrams, the cutting instruments 1, 2 in the illustrated embodiment are each provided with two blades $3_1$, $3_2$ and $4_1$, $4_2$ respectively. However, the cutting instruments can equally well have just one blade or more than two blades, provided that these are spaced equally around the circumference of the cutting instrument, so that by correctly lining up the cutting instruments relative to one another, one obtains a corresponding number of pairs of blades $3_1$, $4_1$ and $3_2$, $4_2$ working together in the cutting zone C. As mentioned above, a larger number of blades should be combined with horizontal mounting of the cutting instruments, the lower disk 2b being provided with a central opening 5 for gravitational removal of cut-off material.

From FIGS. 2 and 1b in particular, it can be seen that the blades are curved, with the leading ends (looking in the direction of rotation) 3a, 4a lying nearest to the periphery of disk 1b and 2b respectively and with the trailing ends (looking in the direction of rotation) 3b, 4b located nearest to the axis of rotation 1a or 2a of the respective disk. The curvature of the blades 3, 4 can, according to the invention, vary within quite wide limits depending on whether various characteristics are prioritized, such as maximum feeding, having the cutting lines where the blades meet coincide exactly during the entire cutting process, or low production costs. The diagrams show an embodiment that gives satisfactory feeding and little deviation of the cutting lines throughout the cutting process, and at the same time low production costs.

In this embodiment the blades $3_1$, $3_2$, $4_1$, $4_2$ have the shape of an arc of a circle (see in particular FIG. 1b), with the center of the circle $3_1c$, $3_2c$, $4_1c$, $4_2c$ located at a distance R from the respective axis of rotation 1a or 2a of the disk 1b or 2b. This distance R must be equal to at least half the distance between the axes of rotation of the disks, i.e. R must be greater than or equal to B/2. In this embodiment, the displacement of the axes of rotation 1a, 2a of the disks 1b, 2b ensures that the centers of the arcs of the blades coincide at least once (the centers of the arcs of the blades coincide once when R is equal to B/2 and coincide twice when R is greater than B/2) during the final cutting-off phase. By this means, of the blades will have a completely coincident cutting line during at least part of the final severing of the material, while the angle between the blades during the remaining parts of the cutting process will be insignificant (see also FIGS. 5a–c).

As an example it may be mentioned that in an embodiment where the axes of rotation 1a, 2a of the disks 1b, 2b are displaced 20 mm apart, i.e. B is equal to 20 mm, and where the centers of the arcs of the blades are separated by a distance R equal to 10.3 mm, i.e. R is greater than B/2, the centers of the arcs of two meeting blades will coincide twice (at points $P_1$ and $P_2$ in FIG. 1b) over an angle $\alpha$ equal to approximately 28° relative to the rotation of the disks. This is illustrated in FIG. 1b by means of the circles shown there, with centers lying on the axes of rotation of the disks; the centers of the respective blade arcs lie on these circles. In an embodiment of this kind, therefore, the cutting lines of the meeting blades will coincide completely when the centers of the blade arcs coincide in points $P_1$ and $P_2$, and will only deviate by a negligible amount over an angle of rotation $\alpha$ greater than 28°.

As mentioned above, the invention is in no way limited to having the form of the blades exactly as shown, and consequently it is possible to choose for these any form that meets the requirements for infeed, coinciding cutting lines, number of blades, etc. that apply in any particular case. As can be seen from FIG. 3, the blades 3, 4 extend from the disks 1b, 2b in a trapezoidal form such that the cutting edges are formed by an incisor edge 8, 9 sloping back from the leading end of each blade; this incisor edge 8, 9 initiates cutting of the material. The blades also each have a cutting edge 10, 11, parallel to the disk 1a or 2a; this ensures complete severing of the material by virtue of the fact that the distance between the disks 1a and 2b and the height of the cutting edges 10, 11 of the blades 3, 4 are so adjusted relative to one another that the cutting edges 10, 11 pass at a little distance from one another. Even though the trapezoidal form shown is the most advantageous for the blades, the invention is not limited to exactly this form; the cutting edges 10, 11 may be made either shorter or longer.

In certain cases it may be advantageous not to sharpen an edge on the trailing ends of the blades, i.e. the parts corresponding to cutting edges 10, 11, or only to sharpen cutting edges 10, 11 over part of the trailing ends 3b, 4b. In this case the full blade width is therefore retained over part or all of the trailing ends 3b, 4b of the blades. This gives a useful splitting effect during the final phase of the cutting process. Another advantage of this form is that a small deviation from the cutting line of the blades does not become critical during the final cutting phase, since the whole blade width is used and the blades consequently come together along at least part of their width, even if the cutting lines deviate somewhat from each other.

In order to illustrate the advantages of the present invention over known technology, FIGS. 4a–c give a schematic view of the cutting process using that arrangement which, according to the U.S. Pat. No. 4,630,658 mentioned at the start, effects feeding of the material during cutting, while FIGS. 5a–c illustrate the cutting process using the arrangement according to the present invention.

FIG. 4a thus shows the known arrangement in the position when the leading ends of the blades have just met, while FIG. 4b shows the position when the blades are right in front of one another, and FIG. 4c shows the final phase of cutting when the cutting edges are right in front of one another. It can be seen from the figures that, as the cutting instruments rotate in opposite directions, the point at which the blades act together will move continuously inward toward the center of the cutting instruments, so bringing about the desired self-feeding. On the other hand it is also clear that as the blades act together, they are always at quite a large angle to one another, which is obviously disadvantageous for the reasons stated at the beginning. To be sure, the angle between the parts of the blades that are acting together becomes smaller, the closer their form is made to approximate to an arc of a circle with center at the center of the cutting instruments; but it is obvious that the smaller the angle between the blades, the poorer the self-feeding effect becomes. It is therefore impossible to achieve a solution that is optimal in both respects.

FIGS. 5a–c show the corresponding relative positions of the blades in the arrangement proposed according to the invention. The blades are shaped like the arc of a circle with its center at a distance from the center of the respective cutting instruments that is equal to or greater than half the distance between the axes of rotation of the two cutting instruments. Because of this, the parts of the blades that act together remain as good as parallel to one another throughout the entire cutting operation, and their cutting lines coincide completely during the final cutting phase, i.e. when the blade edges act together for the final severing. From FIGS. 5a–c it can also be seen that through this arrangement an optimal self-feeding effect is achieved without impairing the cutting action.

Even though the invention has been described above with special reference to a preferred embodiment thereof, it should be obvious that the invention also comprises such changes and modifications as will naturally occur to the specialist. The scope of the invention shall therefore be limited only by the appended patent claim.

We claim:

1. A self-feeding wood chunker comprising instrument means for feeding and cutting said wood, the instruments being mounted for rotation in opposite directions and at the same speed, the axis of rotation being nonconcentric and spaced apart a defined distance, said instrument means having blade means mounted on surfaces facing one another, said blade means being curved in the direction of rotation such that the leading part thereof is nearer the periphery of the respective instrument means and that the trailing part thereof is nearer to the axis of rotation of the respective instrument means, wherein rotation of said instrument means provides feeding and cutting of said wood by said blade means mounted on said instrument means.

2. A self-feeding wood chunker as recited in claim 1 wherein said blades means have the form of an arc of a circle.

3. A self-feeding wood chunker as recited in claim 2, wherein said circular arc of said blade means has its center located at a distance from the respective axis of rotation of the corresponding instrument means, said distance being greater than or equal to the defined distance of separation of said axis of rotation of said instrument means.

4. A self-feeding wood chunker as recited in claims 1, 2 or 3 wherein said cutting instruments consist of disks arranged horizontally one above the other, the lower disk having central opening for gravitational removal of the cut-off material from the cutting instruments.

5. A self-feeding wood chunker as recited in claims 1, 2 or 3 further comprising, outside of the cutting zone of the cutting instruments, an infeed device consisting of self-centering feed rollers which are pivoted and held against one another by spring loading.

6. A self-feeding wood chunker as recited in claims 1, 2 or 3, wherein said blade means extend from the facing surfaces of the cutting instruments in a generally trapezoidal form with an incisor edge sloping back from the leading end (*3a*, *4a*) of each blade, to initiate cutting of said wood; and in that said blade means also each have a cutting edge parallel to the cutting instrument, to ensure complete severing of said wood.

* * * * *